US005741054A

United States Patent [19]

Becker et al.

[11] Patent Number: 5,741,054

[45] Date of Patent: Apr. 21, 1998

[54] STRUCTURAL FOAM BASE FOR A PORTABLE DISHWASHER

[75] Inventors: Craig H. Becker, Fond-du-lac, Wis.; Bradley B. Hobday, Goldsboro, N.C.

[73] Assignee: White Consolidated Industries, Inc., Cleveland, Ohio

[21] Appl. No.: 689,525

[22] Filed: Aug. 9, 1996

[51] Int. Cl.[6] ..... A47L 15/00

[52] U.S. Cl. ..... 312/228; 280/79.11; 248/678; 134/201; 312/249.8

[58] Field of Search ..... 280/79.11; 134/201; 312/228, 257.1, 249.8, 323, 351.11; 248/678, 647

[56] References Cited

U.S. PATENT DOCUMENTS

| | | | |
|---|---|---|---|
| 3,906,967 | 9/1975 | Bergeson . | |
| 3,918,733 | 11/1975 | Macho et al. | 280/79.11 |
| 4,746,177 | 5/1988 | Lampman et al. . | |
| 4,824,129 | 4/1989 | Rehrig | 280/79.11 |
| 4,940,298 | 7/1990 | Jackson et al. . | |
| 5,230,553 | 7/1993 | Tuller . | |
| 5,368,379 | 11/1994 | Wrangberth . | |

FOREIGN PATENT DOCUMENTS

| | | | |
|---|---|---|---|
| 24 20 302 A1 | 4/1974 | Germany . | |
| 2207894 | 2/1989 | United Kingdom | 280/79.11 |

*Primary Examiner*—Peter M. Cuomo
*Assistant Examiner*—Gerald A. Anderson
*Attorney, Agent, or Firm*—Pearne, Gordon, McCoy & Granger LLP

[57] ABSTRACT

A base for a portable washer having a tub supported by a frame with legs. The base is composed of a structural foam and is movably supported by a plurality of casters having upward-projecting pintles. The base defines a plurality of vertical bores and a compartment for holding a mass of material to counterbalance a door that closes the tub. The base also has a pair of angular surfaces for supporting the legs of the frame. The pintles of the casters are securely disposed within the vertical bores of the base.

18 Claims, 5 Drawing Sheets

STRUCTURAL FOAM BASE FOR A PORTABLE DISHWASHER

BACKGROUND OF THE INVENTION

1. Field of the Invention

This invention relates to washers in general and, more particularly, to portable dishwashers.

2. Description of the Related Art

Washers, such as dishwashers, are often constructed so as to be portable. Generally, a portable washer has a tub, a housing, a door and a base. If the tub is composed of plastic, a frame will also be provided for supporting the tub. The door is pivotally secured to the frame for movement between a vertical closed position and a horizontal open position.

The tub, frame and other components of the portable washer are enclosed by the door and the housing, which is comprised of a base, a top panel and a wrapper. The base is typically a sheet metal panel, while the top panel is a composite having an inner core of particle board and an outer surface of veneer wood. Most wrappers are comprised of a single piece of sheet metal that is bent to form two opposing side walls and a rear wall. Some wrappers, however, are comprised of individual panels of sheet metal secured together by hooks or other means. The top panel is usually secured to the wrapper with screws. Typically, the base is secured to the frame and the wrapper by welding.

In order to permit the portable washer to be moved from one location to another, attachments such as casters, or skids are welded to the bottom of the base. Since the portable washer is movable and is not attached to a fixed structure, a slab of concrete is fastened to the top of the base before the housing is assembled. The slab of concrete acts as a counterweight to prevent the portable washer from tipping over when the door is moved from the closed position to the open position. Usually, the slab of concrete is formed in a mold and then removed for placement into the portable washer.

As can be appreciated, the installation of the base and the concrete slab and the welding of the attachments to the base is a time consuming and labor-intensive procedure. Accordingly, it would be advantageous to have a movable support structure that is simple to assemble and upon which other components of a portable dishwasher can be easily installed. The present invention is directed to such a movable support structure.

SUMMARY OF THE INVENTION

It therefore would be desirable, and is an advantage of the present invention, to provide a movable support structure that is simple to assemble and upon which other components of a portable dishwasher can be easily installed. In accordance with the present invention a movable support structure is provided for a washer having a tub supported by a frame with legs. The movable support structure includes a base and a plurality of casters. A plurality of vertical bores are formed in the base. The base is composed of a structural foam and has a pair of angular surfaces for supporting the legs of the frame. The base is movably supported upon the casters. The casters each have an arcuate member rotatably secured to a mount with an upward-projecting pintle. The pintles are securely disposed within the vertical bores of the base.

Also provided in accordance with the present invention is a washer having a tub, a frame, a door and a base. The tub defines an access opening and has a bottom wall. The frame is secured to the tub and has first and second legs disposed below the bottom wall of the tub. The door is pivotally secured to the frame for movement between a substantially horizontal open position and a substantially vertical closed position wherein the door covers the access opening. The base includes a front portion, a rear portion, and first and second side portions. The rear portion defines a compartment for holding a mass of material to counterbalance the door when the door is moved to the open position. The first and second side portions are joined to the front and rear portions. The first and second side portions respectively have first and second surfaces that respectively support the first and second legs of the frame.

Also provided in accordance with the present invention is a washer having a tub, a frame and a base. The tub defines an access opening and has a bottom wall. The frame is secured to the tub and has first and second legs disposed below the bottom wall of the tub. A plurality of vertical bores are formed in the base. The base is composed of a structural foam and has first and second angular surfaces that respectively support the first and second legs of the frame.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
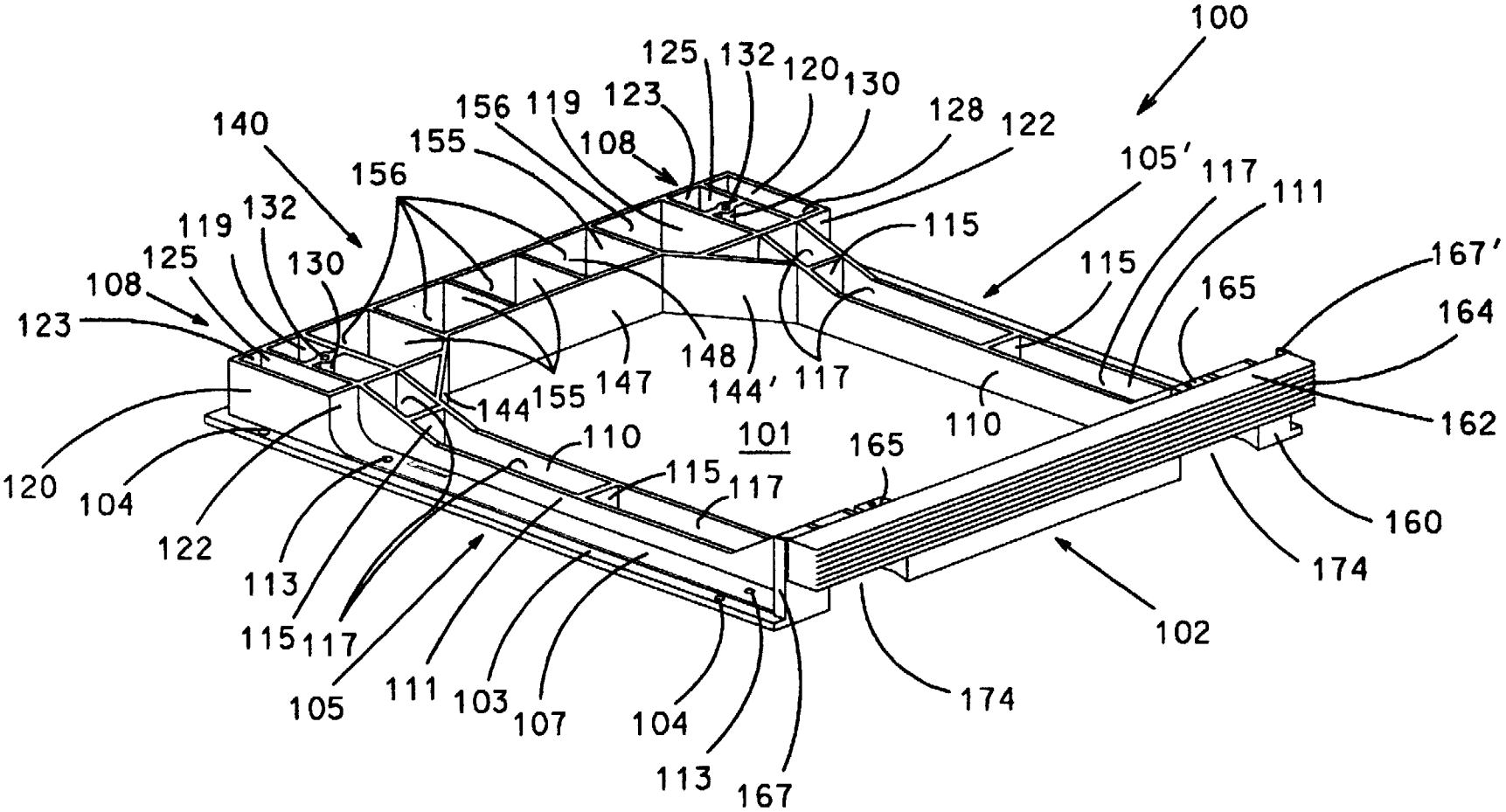
FIG. 1 shows a top perspective view of a base for a washer.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1 there is shown a top perspective view of a base 100 embodied in accordance with the present invention. The base 100 is composed of a structural foam material formed into the shape of a rectangular frame. The structural foam material is talc-filled or glass-filled polypropylene or some other type of plastic material. The base 100 includes a grille 102, a rear structure 140, and first and second side structures 105, 105' that all cooperate to define an open interior or inner void 101 having a substantially rectangular shape. A perimeter flange 103 extends around the first side structure 105, the rear structure 140, and the second side structure 105' so as to respectively have a first side portion, a rear portion and a second side portion, each such portion of the perimeter flange 103 defining a pair of holes 104.

The first and second side structures 105, 105' each include a bottom wall 106 (shown in FIG. 2), a raised side surface 107, a rear corner 108 and inner and outer side walls 110, 111. The raised side surface 107 extends rearward from the grille 102 for a distance and then curves upward to join the rear corner 108. The raised side surface 107 defines a pair of holes 113. The raised side surface 107 is slightly elevated above the perimeter flange 103, which runs adjacent to the raised side surface 107.

The inner and outer side walls 110, 111 are spaced-apart in parallel fashion and extend between the grille 102 and the rear corner 108. Side partitions 115 extend between the inner and outer side walls 110, 111 in perpendicular fashion and are spaced apart to form side compartments 117. The inner and outer side walls 110, 111 slope downward from their ends to a central horizontal portion. The outer side wall 111 adjoins the raised side surface 107 at a substantially right angle so as to form an angled surface.

Each rear corner 108 is delimited by interior and exterior side walls 119, 120 and front and rear walls 122, 123, all of which are of the same height. Extending between the front and rear walls 122, 123 is a central partition 125. A cylindrical projection 130 extends upward from the bottom wall 106 so as to be flush with the front and rear walls 122, 123 and the interior and exterior side walls 119, 120 of the rear corner 108. The cylindrical projection 130 is secured to the central partition 125 and to the interior side wall 119. A bore 132 extends through the cylindrical projection 130 and through the bottom wall 106. The bore 132 has an entrance portion that opens into a circular recess 134 (shown in FIG. 2) defined in part by the bottom wall 106.

The rear structure 140 includes a bottom wall 142 (shown in FIG. 2), first and second angled walls 144, 144' and interior and exterior rear walls 147, 148. The interior and exterior rear walls 147, 148 are spaced apart in parallel fashion. The interior rear wall 147, however, does not extend as far as the exterior rear wall 148. The exterior rear wall 148 extends between the interior side walls 119 of the corners 108 and is seamlessly joined to the rear walls 123 of the corners 108. In contrast, the interior rear wall 147 is spaced inward from the interior side walls 119 of the corners 108. The first angled wall 144 extends between the interior rear wall 147 and the inner side wall 110 of the first side structure 105. Similarly, the second angled wall 144' extends between the interior rear wall 147 and the inner side wall 110 of the second side structure 105'. Rear partitions 155 extend between the interior and exterior rear walls 147, 148 in perpendicular fashion. The rear partitions 155 are spaced apart so as to form rear compartments 156.

The grille 102 is joined to the first and second side structures 105, 105' and to the perimeter flange 103. The grille 102 includes a front wall 160 and an overhang 162 with a hollow interior 163 (shown in FIG. 2). The overhang 162 projects forward from an exterior side of the front wall 160 and has a plurality of horizontally disposed ribs 164. The overhang 162 extends downward for only a portion of the height of the front wall 160 so as to form a front recess 161 (shown in FIG. 5) adjacent to the bottom of the front wall 160. Projecting rearward from an interior side of the front wall 160 are a pair of rectangular projections 165 with bores passing therethrough. First and second offset flanges 167, 167' respectively adjoin first and second ends of the front wall 160 and the overhang 162.

Figure 2:
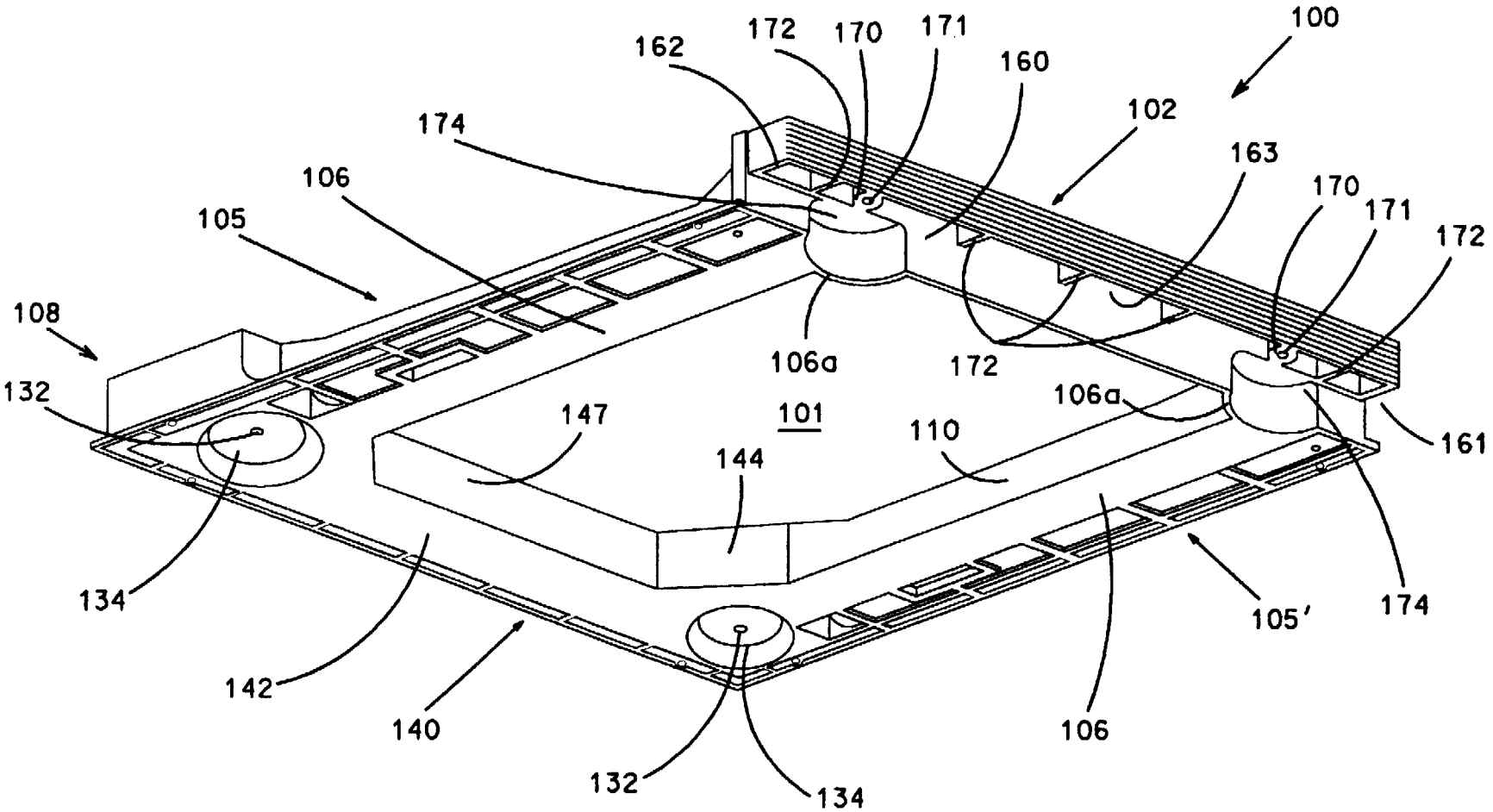
FIG. 2 shows a bottom perspective view of the base.

Referring now to FIG. 2, there is shown a bottom perspective view of the base 100. In this drawing, the hollow interior 163 of the overhang 162, the bottom wall 142 of the rear structure 140 and the bottom walls 106 of the first and second side structures 105, 105' can clearly be seen. Disposed within the hollow interior 163 are a pair of tubular mounts 170 and support walls 172. The tubular mounts 170 each have a bore 171 with entrance portions adjacent to the front recess 161. The entrance portions of the bores 171 have substantially the same diameter as the entrance portions to the bores 132 in the cylindrical projections 130.

The bottom walls 106 of the first and second side structures 105, 105' each include an arcuate portion **106*a* that defines a semi-circular recess 174. The semi-circular recesses 174 open into the front recess through openings in the front wall 160 of the grille 102 that are adjacent to the tubular mounts 170**.

The bottom wall 106 of the first side structure 105 and the bottom wall 142 of the rear structure 140 define a first one of the circular recesses 134, while the bottom wall 106 of the second side structure 105' and the bottom wall 142 of the rear structure 140 define a second one of the circular recesses 134. Majority portions of the circular recesses 134 are respectively located beneath the rear corners 108. As described earlier, the bores 132 in the cylindrical projections 130 open into the circular recesses 134.

Figure 3:
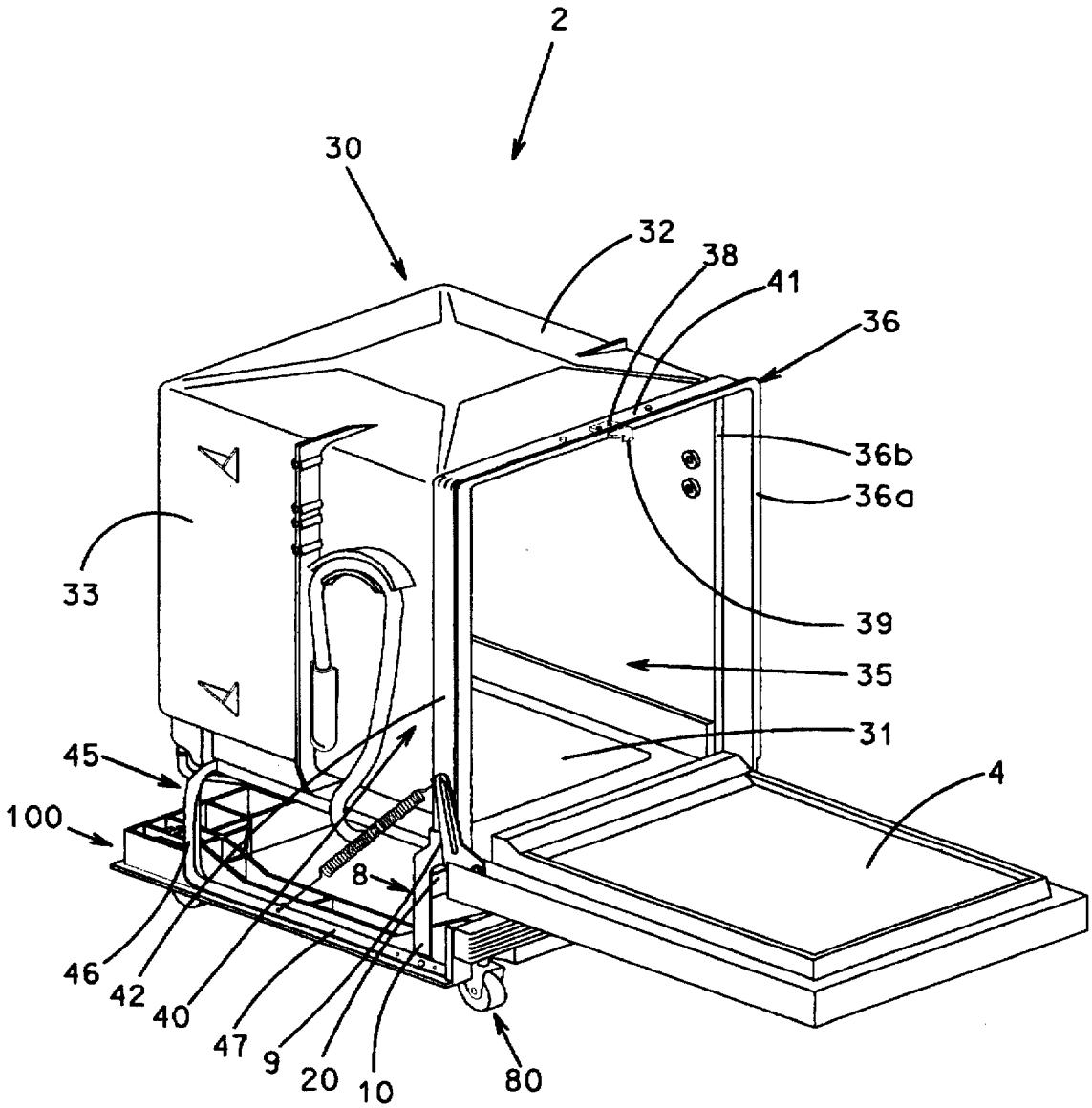
FIG. 3 shows a perspective view of a portion of the washer with the base.

Referring now to FIG. 3, there is shown a perspective view of a portion of a washer 2, such as a dishwasher. The washer 2 generally includes the base 100, a door 4, a tub 30, a door or front frame 40, a support or rear frame 45, a first offset leg 8, a second offset leg (not shown) and a front brace 20. The door 4 is pivotally secured to the first offset leg 8 and the second offset leg so as to move between an open position (shown in FIG. 3) and a closed position. In the open position, the door 4 is substantially horizontal and is spaced from an access opening 35 in the tub 30. In the closed position, the door 4 is substantially vertical and covers the access opening 35.

The tub 30 has an integrally molded plastic construction and generally includes a bottom wall 31, a top wall 32, a pair of opposing side walls 33 and a rear wall (not shown). The exterior of the bottom wall 31 has integrally molded ribs (not shown) projecting downward therefrom. The side walls 33 and the top wall 32 flare outward near the front access opening 35 so as to form a collar 36 around the access opening 35. The collar 36 has an outer flange **36*a* and an interior recessed shoulder 36*b* that provides a seat for the door 4**.

The front brace 20, the front frame 40, the rear frame 45, the first offset leg 8 and the second offset leg combine to form a frame that supports and secures the tub 30. The front frame 40 helps prevent lateral movement and vertical deformation of the tub 30, while the front brace 20, the rear frame 45, the first offset leg 8 and the second offset leg support the tub 30 on the base 100. In addition, the rear frame 45 engages the integrally molded ribs on the exterior of the bottom wall 31 so as to prevent forward and rearward movement of the tub 30.

The front frame 40 is composed of steel and has a channel-shaped cross-section. The front frame 40 is formed to have an inverted U-shaped configuration and includes a bight 41, a first downward-projecting leg 42 and a second downward-projecting leg (not shown). The first downward-projecting leg 42 and the second downward-projecting leg are respectively secured to the first offset leg 8 and the second offset leg. The front frame 40 is disposed around the collar 36 of the tub 30 on an interior side of the outer flange **36*a*. A mounting plate, 38 is centrally mounted to the bight 41 of the front frame 40 on the interior side of the outer flange 36*a*. Located on an exterior side of the outer flange 36*a* is a striker 39. The mounting plate 38 and the striker 39 are secured together with the outer flange 36*a* firmly clamped in between. In this manner, the front frame 40 is rigidly attached to the tub 30**.

The rear frame 45 is also composed of steel and has a channel-shaped cross section. The rear frame 45, however, is formed to have a folded U-shape and includes a horizontal cross bar (not shown) with opposing ends that bend into a first vertical leg 46 and a second vertical leg (not shown). The first vertical leg 46 and the second vertical leg, in turn, respectively bend into a first horizontal leg 47 and a second horizontal leg (not shown) that extend forward and terminate at outer ends.

The first horizontal leg 47 and the second horizontal leg each have inner and outer flanges projecting upward from a central planar member. A pair of mounting holes are formed in the central planar member of each of the first horizontal leg 47 and the second horizontal leg. The first horizontal leg 47 and the second horizontal leg are respectively secured to the raised side surfaces 107 of the first and second side structures 105, 105' of the base 100 by screws or bolts that pass through the mounting holes in the first horizontal leg 47 and the second horizontal leg and the holes 113 in the raised side surfaces 107. In this manner, the first horizontal leg 47 and the second horizontal leg are supported both laterally and vertically by the angular surfaces formed by the outer side walls 111 and the raised side surfaces 107. Specifically, the raised side surfaces 107 vertically support the central planar members of the first horizontal leg 47 and the second horizontal leg, while the outer side walls 111 support the inner flanges of the first horizontal leg 47 and the second horizontal leg against lateral inward movement.

The first horizontal leg 47 and the second horizontal leg are also respectively secured to the first offset leg 8 and the second offset leg. The first offset leg 8 and the second offset leg embody a construction more particularly disclosed in assignee's co-pending patent application entitled "OFFSET LEG", Ser. No. 08/690,558, which is incorporated herein by reference. The first offset leg 8 and the second offset leg are each composed of steel and each include a neck portion 9 offset from an upright portion 10 having an indented lower end. The indented lower ends of the first offset leg 8 and the second offset leg are secured to the first horizontal leg 47 and the second horizontal leg toward their outer ends.

Figure 4:
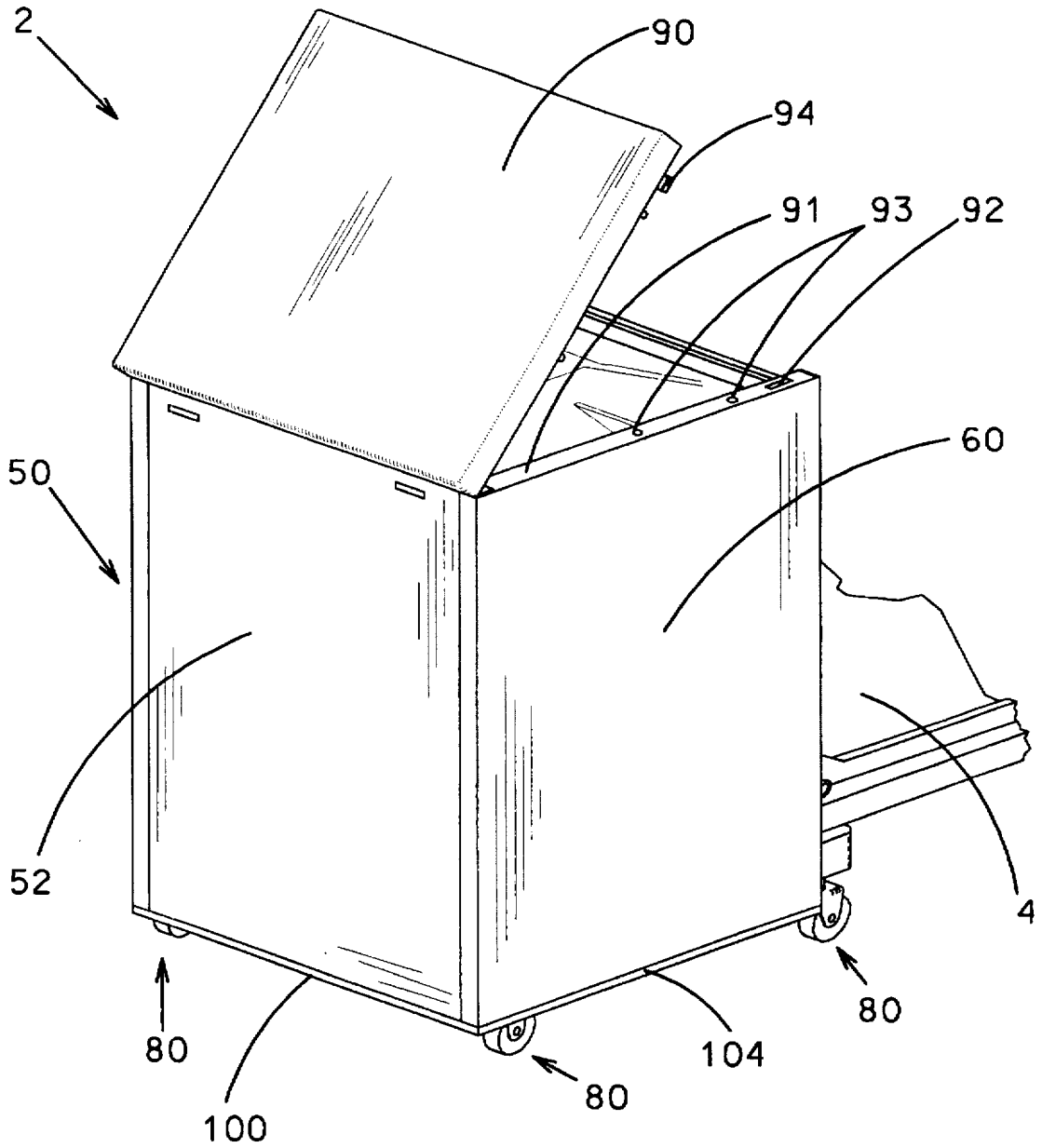
FIG. 4 shows a perspective view of the washer with a wrapper mounted on the base.

Referring now to FIG. 4, a rear perspective view of the washer 2 is shown. A wrapper 50 is mounted on the perimeter flange 103 of the base 100. The wrapper 50 is disposed around the tub 30, the front frame 40 and the rear frame 45. The wrapper 50 is comprised of three separate sheet metal panels: a rear panel 52, a first side panel 60 and a second side panel (not shown). The first side panel 60 and the second side panel each have a top flange 91 that defines a rectangular aperture 92 and a plurality of circular openings 93. The first side panel 60, the second side panel and the rear panel 52 each have a bottom flange (not shown) that defines a pair of holes. The holes in the bottom flanges are aligned with the holes 104 in the perimeter flange 103 so as to form wrapper mounting passages. The bottom flanges of the first side panel 60, the second side panel and the rear panel 52 are respectively secured to the first side portion, second side portion and rear portion of the perimeter flange 103 by screws or bolts that pass through the wrapper mounting passages.

A top panel 90 is shown angled above the wrapper 50. The top panel 90 has snap-fits 94 that snap into the rectangular apertures 92 to secure the top panel 90 on top of the wrapper 50. The top panel 90 is composed of the same structural foam material that is used to form the base 100. As previously stated, the structural foam material is talc-filled or glass-filled polypropylene or some other type of plastic material. The construction and mounting of the top panel 90 is more particularly disclosed in assignee's co-pending patent application entitled "STRUCTURAL FOAM TOP FOR PORTABLE DISHWASHER", Ser. No. 08/692,524, which is incorporated herein by reference.

Figure 5:
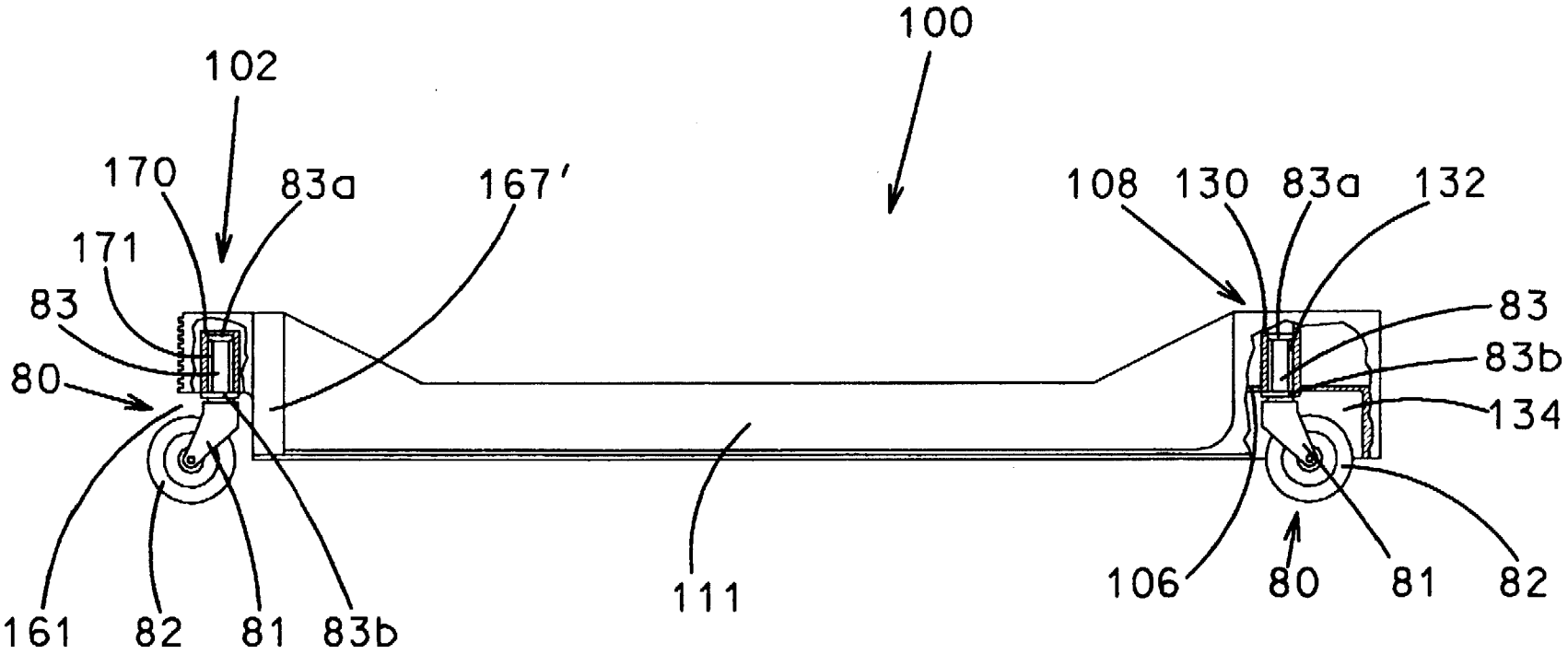
FIG. 5 shows a partially cut-away side view of a portion of the base.

Referring now also to FIG. 5, there is shown a partially cut-away side view of the base 100. The base 100 is supported on caster assemblies 80. Each of the caster assemblies 80 has a pair of bifurcated arms 81, a caster wheel 82 and a pintle 83. The caster wheel 82 is rotatably secured within the bifurcated arms 81 by pins that pass through openings in the caster wheel 82 and the bifurcated arms 81. The pintle 83 has an enlarged head **83*a* and a bottom flange 83*b*. The pintle 83 projects upward from the bifurcated arms 81**.

The pintles 83 of a front pair of the caster assemblies 80 are securely disposed within the bores 171 of the tubular mounts 170, while the pintles 83 of a rear pair of the caster assemblies 80 are securely disposed within the bores 132 passing through the cylindrical projections 130 and the bottom walls 106. Top portions of the bifurcated arms 81 and caster wheels 82 of the front pair of caster assemblies 80 are disposed within the front recess 161 and can rotate into the semi-circular recesses 174. Top portions of the bifurcated arms 81 and caster wheels 82 of the rear pair of caster assemblies 80 are disposed within the circular recesses 134. In this manner, the base 100 and the caster assemblies 80 comprise a movable support structure with a low profile.

Pressure must be applied to the pintles 83 in order to insert them into the bores 132,171 because the enlarged heads **83*a* have diameters that are the same or slightly smaller than the diameters of the entrance portions to the bores 132, 171. The bottom flanges 83*b*, however, have diameters substantially larger than the entrance portions to the bores 132, 171 and, thus, cannot pass through the entrance portions. Thus, when pressure is applied to the pintles 83, the enlarged heads 83*a* of the pintles 83 snugly pass through the entrance portions and enter the bores 132, 171, while the bottom flanges 83*b* remain outside the bores 132, 171 and impinge on outside surfaces of the tubular mounts 170 and portions of the bottom walls 106 within the circular recesses 134. In this manner, a snap-fit connection is provided between the base 100 and the pintles 83 of the caster assemblies 80**.

The caster assemblies 80 enable the washer 2 to be moved from one location to another, i.e. to be portable. It should be appreciated, however, that moving means other than the caster assemblies 80 can be utilized to make the washer 2 portable. For example, ball and socket assemblies fitted with mounting pintles can be used. Skids fitted with mounting pintles can also be used.

Since the washer 2 is portable and is not attached to a fixed structure, blocks of cement are disposed within the rear compartments 156 of the rear structure 140 to act as counterweights to prevent the washer 2 from tipping over when the door 4 is moved to a horizontal open position as shown in FIG. 3. In order to form the blocks of cement, wet cement is poured into the rear compartments 156 and allowed to dry prior to the assembly of the washer 2. Thus, the rear compartments 156 function as molds as well as retainers for the cement blocks. In this manner, the need to form a cement slab in an exterior mold is eliminated, thereby reducing the labor required to assemble the washer 2.

Although the preferred embodiments of this invention have been shown and described, it should be understood that various modifications and rearrangements of the parts may be resorted to without departing from the scope of the invention as disclosed and claimed herein.

What is claimed is:

1. A movable support structure for a washer having a tub supported by a frame with legs, said support structure comprising:

a base with a plurality of vertical bores formed therein, said base being composed of a structural foam and including:

a front portion;

a rear portion defining a compartment for holding a mass of material; and first and second side portions joined to the front and rear portions, said first and second side portions each having an upwardly-extending surface adjoining an inner side edge of a horizontal surface adapted to support one of the legs of the frame, said inner side edges each extending between the front and rear portions; and a plurality of casters upon which the base is disposed, said casters each having an arcuate member rotatably secured to a mount with an upward-projecting pintle, said pintles being securely disposed within the vertical bores of the base.

2. The movable support structure of claim 1 wherein the structural foam is polypropylene.

3. The movable support structure of claim 1 wherein the base is substantially rectangular.

4. The movable support structure of claim 1 wherein the front and rear portions and the first and second side portions define an inner void having a substantially rectangular shape.

5. A washer comprising:

a tub defining an access opening and having a bottom wall;

a frame secured to the tub and having first and second legs disposed below the bottom wall of the tub;

a base with a plurality of vertical bores formed therein, said base being composed of a structural foam and including:

a front portion;

a rear portion defining a compartment for holding a mass of material; and first and second side portions having first and second horizontal surfaces that respectively support the first and second legs of the frame, said first and second side portions being joined to the front and rear portions so as to form an inner void having a substantially rectangular shape.

6. The washer of claim 5 wherein the structural foam is polypropylene.

7. The washer of claim 6 further comprising a plurality of casters upon which the base is movably supported, said casters each having an arcuate member rotatably secured to a mount with an upward-projecting pintle, said pintles being securely disposed within the vertical bores of the base.

8. A washer comprising:

a tub defining an access opening and having a bottom wall;

a frame secured to the tub and having first and second legs disposed below the bottom wall of the tub;

a door pivotally secured to the frame for movement between a substantially horizontal open position and a substantially vertical closed position wherein the door covers the access opening; and a base comprising:

a front portion;

a rear portion defining a compartment for holding a mass of material to counterbalance the door when the door is moved to the open position; and first and second side portions joined to the front and rear portions, said first and second side portions respectively having first and second surfaces that respectively support the first and second legs of the frame.

9. The washer of claim 8 wherein the first and second surfaces are angular.

10. The washer of claim 8 wherein the base is substantially rectangular, and wherein the front and rear portions and the first and second side portions define an inner void having a substantially rectangular shape.

11. The washer of claim 9 wherein the front portion defines a pair of vertical front bores and wherein the first and second side portions each define a vertical rear bore.

12. The washer of claim 11 further comprising a pair of front casters and a pair of rear casters upon which the base is movably supported, said front and rear casters each having an arcuate member rotatably secured to a mount with an upward-projecting pintle, said pintles of the front casters being securely disposed within the vertical front bores of the base and said pintles of the rear casters being securely disposed within the vertical rear bores of the base.

13. The washer of claim 12 wherein the first and second side portions each further comprise parallel inner and outer longitudinal walls and a raised side surface adjoining the outer longitudinal wall, said outer longitudinal wall and raised side surface of the first side portion forming the first surface and said outer longitudinal wall and raised side surface of the second side portion forming the second surface.

14. The washer of claim 13 wherein the rear portion of the base further comprises parallel interior and exterior walls and a plurality of dividers extending therebetween, said interior and exterior walls and the dividers helping to define the compartment for holding the mass of material.

15. The washer of claim 14 wherein the base further comprises a perimeter flange extending around the first side portion, the rear portion and the second side portion.

16. The washer of claim 15 further comprising a wrapper partially disposed around the tub and the frame and supported on the perimeter flange of the base.

17. The washer of claim 8 wherein the base is composed of a structural foam.

18. The washer of claim 8 wherein the structural foam is polypropylene.

* * * * *

UNITED STATES PATENT AND TRADEMARK OFFICE

CERTIFICATE OF CORRECTION

PATENT NO. : 5,741,054

DATED : April 21, 1998

INVENTOR(S) : Becker et al.

It is certified that error appears in the above-identified patent and that said Letters Patent is hereby corrected as shown below:

In Claim 7, please delete "6" and insert --5--.

Signed and Sealed this

FourthDay of August, 1998

Bruce Lehman

*Attest:*

BRUCE LEHMAN

*Attesting Officer*

*Commissioner of Patents and Trademarks*